US005422003A

United States Patent [19]

Kataoka

[11] Patent Number: 5,422,003

[45] Date of Patent: Jun. 6, 1995

[54] GAS-LIQUID SEPARATION FLOW RATE REGULATOR IN SEWAGE DISPOSAL TANK

[75] Inventor: Ikuo Kataoka, Ohtsuki, Japan

[73] Assignee: Yamashou Sangyo Kabushiki Kaisha, Yamanashi, Japan

[21] Appl. No.: 171,678

[22] Filed: Dec. 22, 1993

[30] Foreign Application Priority Data

Jun. 8, 1993 [JP] Japan ..... 5-164122

[51] Int. Cl.[6] ..... B01D 19/00

[52] U.S. Cl. ..... 210/188; 96/220; 210/197; 210/521; 137/173; 137/179

[58] Field of Search ..... 210/137, 188, 195.1, 210/195 B, 197, 521, 532.1, 532.2, 194, 916; 96/197, 204, 220; 137/173, 179, 181, 583

[56] References Cited

U.S. PATENT DOCUMENTS 3,396,102 8/1968 Forrest ..... 210/197
4,576,720 3/1986 Mandt ..... 210/197

*Primary Examiner*—Joseph W. Drodge
*Attorney, Agent, or Firm*—Browdy and Neimark

[57] ABSTRACT

This invention is directed to a gas/liquid separation flow rate regulator, which effectively carries out gas/-liquid separation by preventing an uncontrolled flow of sewage and facilitates control of liquid flow. To accomplish this objective, the outer shell of the gas/liquid separation flow rate regulator is cylindrical in shape with its inner periphery providing a cylindrical surface. An edge inclining unidirectly from one end to the other is formed at the upper edge of a partition plate for dividing the cylindrical shell into two chambers, and the lower end of this inclined edge is butted to the cylindrical surface of the cylindrical member so as to form an overflow weir. A return port is centrally located on the cylindrical member and is disposed on the opposite side surface of the cylindrical member facing the overflow weir.

1 Claim, 4 Drawing Sheets

*PRIOR ART*

GAS-LIQUID SEPARATION FLOW RATE REGULATOR IN SEWAGE DISPOSAL TANK

BACKGROUND OF THE INVENTION

1. Field of the Invention

This invention relates to a gas-liquid separation flow rate regulator in a sewage disposal tank, which separates air in sewage sucked through a suction pipe, suspended in the tank and connected to an air lift pump, from sewage at the upper end of the suction piper. This invention finely regulates the flow rate of sewage and returns a suitable amount of regulated sewage back to a treatment tank in a preceding stage.

2. Description of the Related Art

A conventional gas-liquid separation flow rate regulator of this kind has the construction shown in FIG. 6. Namely, a square regulation box A is disposed at the upper end of a suction pipe 3 suspended into a tank and the inside of this regulation box is divided into a primary inflow chamber 8 and a secondary inflow chamber 9 by a partition plate 7 having a V-shaped overflow portion 10 at the center of the upper edge thereof. A discharge port 3*a* of the suction pipe 3 is downwardly opened into the primary inflow chamber 8, and the lower end of a gate plate 11 capable of moving up and down is disposed so as to face the bottom surface of the primary inflow chamber 8. An escape port 4*a* bored through the bottom surface of the regulation box A is disposed so as to face the back side of the gate plate 11 and a return port 12 of regulated sewage is disposed in the secondary inflow chamber 9.

The operation of this regulator is as follows. A large quantity of sewage sucked by the air lift pump is discharged from the discharge port 3*a* of the suction pipe 3 into the primary inflow chamber 8, and sewage thus discharged is caused to flow out through a predetermined gap between the lower surface of the gate and the bottom surface of the regulation box A which is set in advance by the positioning of gate plate 11. After being first regulated in this way, sewage flow into the secondary in flow chamber through the overflow portion 10 is then regulated, and sent back to a treatment tank of a preceding stage through the return port 12. This type of construction is an typical of this kind of conventional gas-liquid separation flow rate regulators.

Since the conventional gas-liquid separation flow rate regulator A described above employs the rectangular box at its main body, each of the inside surfaces of the box is a flat wall. As a result, air-containing sewage rigorously discharged downward from the discharge port 3*a* of the suction pipe 3 impinges against the inside bottom wall surface of the primary inflow chamber 8 and causes the water level of the inflow chamber 8 to assume a vigorous uncontrolled flow state. Accordingly, gas-liquid separation cannot be accomplished in a satisfactory manner. When sewage passes through the overflow portion 10 in this uncontrolled flow state, it cannot be settled nor can it flow into the secondary inflow clamber 9 from the overflow portion 10 as expected. Accordingly, satisfactory water regulation is problematic and cannot be obtained in a suitable manner.

SUMMARY OF THE INVENTION

It is therefore an object of the present invention to overcome this problem of uncontrolled water flow, to facilitate effective gas-liquid separation and suitable water quantity regulation, and to reduce the size of the regulation box.

In a disposal tank of the type wherein a suction pipe of sewage connected to an air lift pump is inserted and suspended into a tank and a gas-liquid separation flow rate regulator is disposed at the upper end of the suction pipe, a gas-liquid separation flow rate regulator that achieves the object described above employs the construction where an outer shell constituting the gas-liquid separation flow rate regulator comprises a transversely elongated cylindrical member, the inner periphery of which has a cylindrical surface. Both ends of the elongated cylindrical member is fitted with end plates. The cylindrical member has an air escape hole at the upper surface thereof, and the lower portion of the inside of this cylindrical member is partitioned into a primary inflow chamber and a secondary inflow chamber by a partition plate having an inclined edge which inclines unidirectionally from the cylindrical surface of the cylindrical member to the cylindrical surface at the upper edge thereof. The overflow portion is defined by the inclined edge sending as an overflow weir and the upper cylindrical surface facing the inclined edge. A discharge port of the suction pipe is opened downward towards the inner bottom cylindrical surface of the primary inflow chamber, and an escape port for sewage is formed in the end plate of the cylindrical member constituting the secondary inflow chamber. A gate plate, rotatably disposed on the surface of the end plate, has an opening that can be displaceably superposed on this escape port to regulate the flow through this escape port. A sewage return port is disposed on the side surface of the secondary inflow chamber opposing the overflow portion for returning a suitable amount of sewage, which is regulated by escape quantity of sewage from the escape port, to a treatment tank in a preceding stage.

DESCRIPTION OF THE PREFERRED EMBODIMENT

Figure 1:
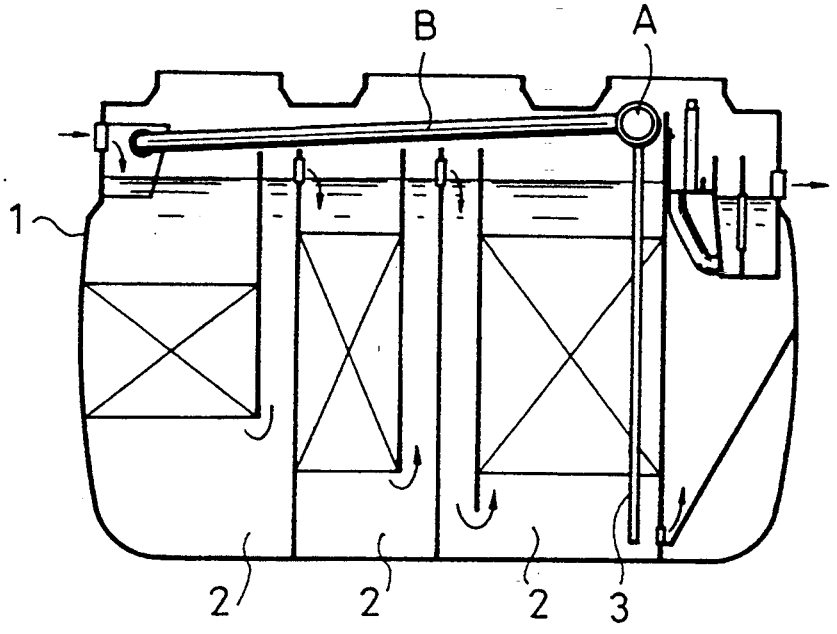
FIG. 1 is a longitudinal sectional front view of a sewage disposal tank.

In FIG. 1, reference numeral 1 denotes the tank body of a sewage disposal tank. This tank body 1 includes a large number of treatment chambers 2 which communicate with one another from an inlet on the front side towards an outlet on the rear side, and a suction pipe 3 connected to an air lift pump (not show) is suspended in a predetermined treatment chamber 2. A gas-liquid separation flow rate regulator A regulates the quantity of sewage sucked up and returns a suitable amount of regulated sewage to the treatment chamber 2 on the front side through a conduit B fitted to the upper end of the suction pipe 3.

Figure 2:
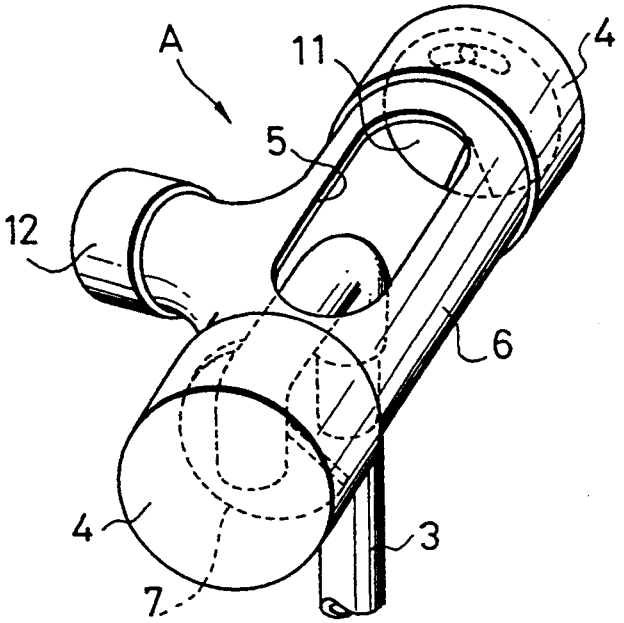
FIG. 2 is a perspective view of a cylindrical member constituting a gas-liquid separation flow rate regulator.
Figure 3:
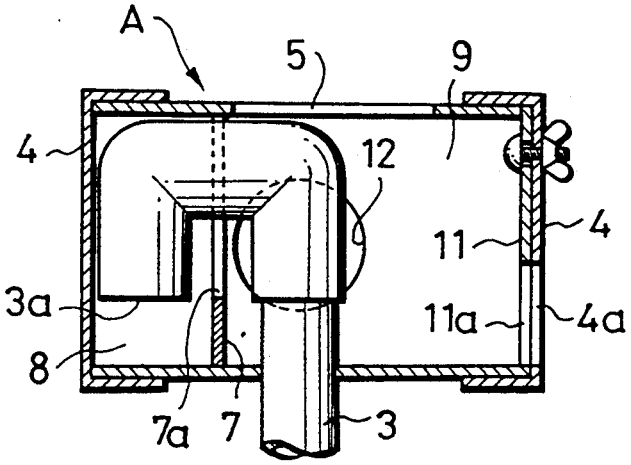
FIG. 3 is a sectional side view of the cylindrical member.

According to the present invention and as shown in FIG. 2 and FIG. 3, the outer shell of the gas-liquid separation flow rate regulator A described above comprises a transversely elongated cylindrical member 6 which has a cylindrical inner surface, both ends of which are closed by end plates 4, and which has an air vent/inspection window hole 5 on the upper surface thereof in an axial direction.

The inside of the cylindrical member 6 is divided into primary and secondary inflow chambers 8 and 9 for regulating the quantity of sewage, by a partition plate 7 orthogonally crossing the axis of the cylindrical member 6.

Figure 4:
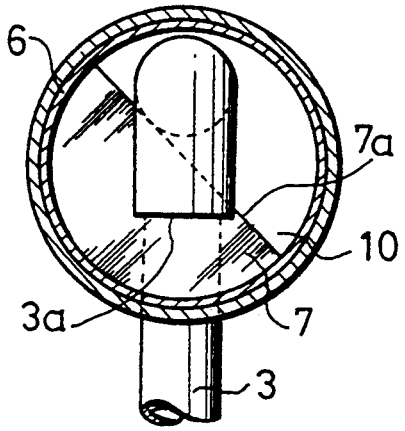
FIG. 4 is a longitudinal sectional front view of a primary inflow chamber.
Figure 5:
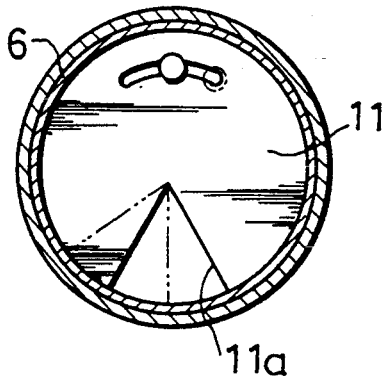
FIG. 5 is a longitudinal sectional front view of a secondary inflow chamber.
Figure 6:
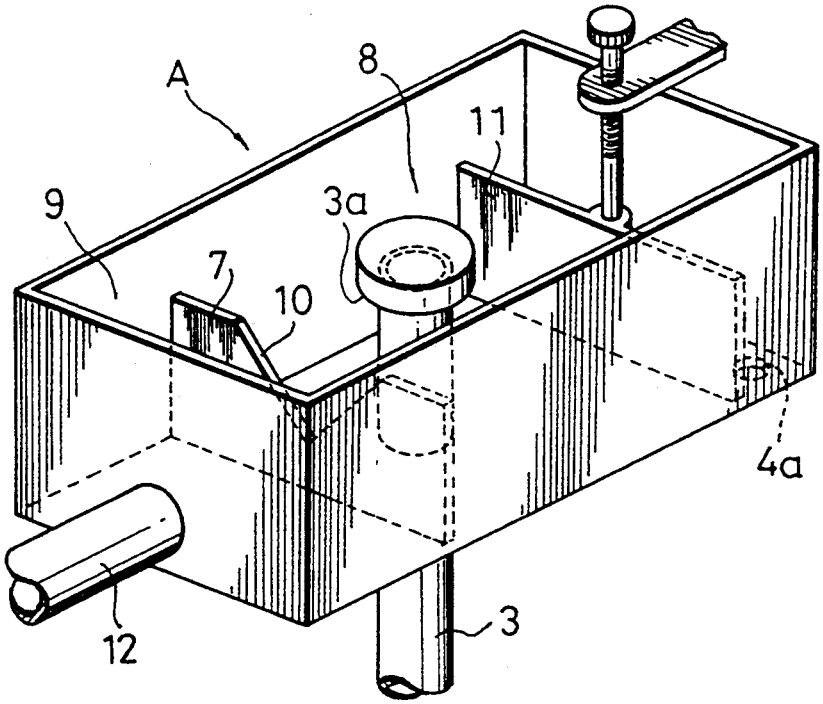
FIG. 6 is an explanatory perspective view of a gas-liquid separation flow rate regulator according to the prior art.

The partition plate 7 has, at its upper edge, an inclined edge *7a* having a shed-roof shape with an incline of about 45° extending from the lower part of the inside cylindrical surface of the cylindrical member 6 to the opposing upper part of the inside cylindrical surface of the cylindrical member 6. The lower end of the inclined edge *7a* is brought into contact with the lower part of the cylindrical inner surface of the cylindrical member 6 so that an overflow portion 10 formed by the cross-sectional area of cylindrical member 6 which is not covered over by partition plate 7 (FIG. 4).

The discharge port *3a* of the suction pipe 3 is opened downward towards the inner bottom cylindrical surface of the primary inflow chamber 8 by allowing the pipe to penetrate through the bottom surface of the secondary inflow chamber 9 and extend into the primary inflow chamber 8 after crossing over the upper edge of the partition plate 7.

An escape port *4a* having an inverted V-shape (about 60°) is formed on the end plate 4 of the cylindrical member constituting the secondary inflow chamber 9, and a round gate plate 11 is superposed on this end plate 4 so that the gate plate 11 can turn and have its rotating position freely fixed. An opening 11*a* having the same size and shape as that of the escape port *4a* is formed in the gate plate 11 to allow for adjustment of its position relative to escape port *4a* through rotation of the gate plate.

A return port 12 of sewage overflowing from the overflow portion 10 is disposed on the side wall portion positioned opposite to the overflow portion 10 of the secondary inflow chamber 9, and a return conduit B for another treatment tank is connected to this return port 12.

In this embodiment, the end plate 4 at the end of the primary inflow chamber 8 of the cylindrical member 6 comprises a fitted cover which is removable from the cylindrical member 6 for the purpose of cleaning the inside of the cylindrical member 6.

Sewage sucked by the air lift pump, not shown in the drawing, is vigorously discharged downward to the inner bottom surface of the primary inflow chamber 8 from the discharge port *3a* of the suction pipe 3. Since this inner bottom surface is a cylindrical surface, the resulting water buffering action prevents an uncontrolled flow of water. During pressurization of the pump, the discharge port *3a* is submerged below the level of sewage flowing into the primary inflow chamber 8 and the discharge of water is made under water. Accordingly, air, which mixes with sewage are separated from the sewage and is released from above the inclined portion of the partition plate 7.

After having been harnessed by the gas-liquid separation action and by the uncontrolled flow prevention action described above, sewage overflows the overflow portion 10 and flows into the secondary inflow chamber 9. Since one wall of the overflow portion 10 has a cylindrical surface, the resulting water buffering action restricts the splashing of water.

After flowing into the secondary inflow chamber 9, sewage is allowed to escape from the outlet. All of the opening 11a of the gate plate 11 over escape port *4a*, and the quantity of water inside the secondary inflow chamber 9 is thus adjusted. After being regulated in this way, sewage is returned to other treatment tanks by the return port 12 of the secondary inflow chamber 9. In this instance, since the return port 12 is disposed on the side surface of the secondary inflow chamber 9 opposing the overflow portion 10, sewage overflowing the overflow portion 10 does not directly reach the return port 12 but flows in a direction transversely crossing the cylindrical surface. Consequently, the level Of sewage is settled further, and sewage flows out via the return port 12.

Effect of the Invention

As described above, the present invention provides the following effects.

(a) The inner bottom surface of the primary inflow chamber is shaped into the cylindrical surface, and sewage is downwardly discharged towards this inner bottom cylindrical surface. Accordingly, the inner bottom cylindrical surface plays the function of the buffering action of water and can prevents the uncontrolled flow of water.

(b) The upper edge of the partition plate is unidirectionally inclined from one of its ends to the other, and the lower end of this inclined edge is brought into contact with the cylindrical surface on one of the sides of the cylindrical member in such a manner as to define the overflow portion of sewage inside the primary inflow clamber by this cylindrical surface and the inclined edge. Accordingly, when sewage is subjected to gas/liquid separation inside the primary inflow chamber, air can be effectively released from the inclined rising side of the partition plate, and only water is allowed to pass the overflow portion. In this way, the cause for the uncontrolled flow of water can be removed effectively.

(c) The return port is disposed on the side surface of the secondary inflow chamber opposing the overflow portion. Therefore, sewage overflowing the overflow portion flows in a detour manner while transversely crossing the inner cylindrical surface of the secondary inflow chamber, so that flow of sewage can be settled down and sewage can be sent into the return port under the state where the quantity of water is suitably controlled.

(d) The outer shell of the gas/liquid separation flow rate regulator is shaped by the cylindrical member. Accordingly, the regulator can be constituted compactly as a whole.

What is claimed is:

1. A gas-liquid separation flow rate regulator in a sewage disposal tank, comprising:

a hollow cylindrical member having a cylindrical inner surface with a first end and a second end, and being disposed horizontally on its longitudinal axis to form an upper portion and a lower portion whereby said cylindrical member serves as an outer shell for said gas-liquid separation flow rate regulator, said hollow cylindrical member having an air vent extending through said upper portion of said hollow cylindrical member;

a partition plate having an edge inclined from horizontal and being disposed on said cylindrical inner surface to partition said hollow cylindrical member into a first chamber and a second chamber, said inclined edge of said partition plate inclining unidirectionally from said lower portion to said upper portion of said hollow cylindrical member to define an overflow weir;

a suction pipe disposed through said lower portion of said hollow cylindrical member and having a discharge port disposed in said first chamber so as to discharge sewage downward along said cylindrical inner surface;

a first end plate fitted over said first end of said hollow cylindrical member and forming a side of said first chamber;

a second end plate fitted over said second end of said hollow cylindrical member and having an opening therethrough, said opening serving as an escape port communicating with said second chamber of said hollow cylindrical member;

a circular gate plate having an opening therethrough corresponding in shape to said opening of said second end plate, said circular gate plate being rotatably engaged to said second end plate so that said circular gate plate opening is capable of rotating relative to said opening of said second end plate whereby sewage flow is regulated through said escape port; and a sewage return port communicating with said second chamber of said hollow cylindrical member and being centrally disposed on said hollow cylindrical member.

* * * * *